US008117962B2

(12) United States Patent
Moes et al.

(10) Patent No.: US 8,117,962 B2
(45) Date of Patent: Feb. 21, 2012

(54) EQUIPMENT FOR PREPARING DAMPENING SOLUTIONS FOR OFFSET PRINTING

(75) Inventors: Eike Moes, Ahlen (DE); Christian Brüggemann, Rheda-Wiedenbruck (DE)

(73) Assignee: Technotrans AG, Sassenberg (DE)

( * ) Notice: Subject to any disclaimer, the term of this patent is extended or adjusted under 35 U.S.C. 154(b) by 791 days.

(21) Appl. No.: 11/851,025

(22) Filed: Sep. 6, 2007

(65) Prior Publication Data

US 2008/0060537 A1 Mar. 13, 2008

(30) Foreign Application Priority Data

Sep. 7, 2006 (DE) ..... 10 2006 042 091

(51) Int. Cl.
*B41L 25/00* (2006.01)

(52) U.S. Cl. ..... 101/147; 101/148

(58) Field of Classification Search ..... 101/147, 101/148

See application file for complete search history.

(56) References Cited

U.S. PATENT DOCUMENTS

| | | | | |
|---|---|---|---|---|
| 3,352,317 | A * | 11/1967 | Dahlgren | 137/339 |
| 3,358,704 | A | 12/1967 | Wyatt et al. | |
| 3,741,115 | A * | 6/1973 | Keller | 101/148 |
| 3,858,602 | A | 1/1975 | Brym | |
| 3,893,470 | A | 7/1975 | MacPhee et al. | |
| 4,394,870 | A | 7/1983 | MacPhee et al. | |
| 6,508,069 | B2 * | 1/2003 | Sibilia | 62/201 |
| 2005/0061188 | A1 | 3/2005 | Krieg et al. | |

FOREIGN PATENT DOCUMENTS

| | | | |
|---|---|---|---|
| DE | 1263020 | A | 3/1968 |
| DE | 1457277 | A | 12/1970 |
| DE | 2336589 | C2 | 1/1975 |
| DE | 2521944 | C2 | 12/1975 |
| DE | 2724320 | C2 | 11/1978 |
| DE | 94 13 438 | U1 | 6/1995 |
| DE | 10 2004 063 790 | A1 | 7/2006 |
| EP | 1 092 534 | A1 | 4/2001 |
| EP | 1238802 | B1 | 9/2002 |
| EP | 1500499 | A1 | 1/2005 |
| EP | 1679186 | B1 | 7/2006 |

OTHER PUBLICATIONS

E1: Operating instructions, "Feuchtwasser-, Umwälz- and Kühlgerät 831 to 836" (830 series); introduction, pp. 1 to 8; table of contents, pp. 1, 2; pp. 1-1 to 7-25, different imprints 02.98, 01.95, 8.88, 2.89 .

E2: Design drawing No. 000. 1.030590.31, dated Jan. 27, 1993.

E4: Brochure of the company Baldwin-Germany GmbH with the imprint "Printed in W. Germany 4.90", pp. 1 to 6.

E6: Several images of the exhibition stand of the company MAN Roland Druckmaschinen AG on the DRUPA 1986 (May 2 to May 15, 1986 in Dusseldorf), 2 pages.

E7: Design drawing No. 000.1.200615.0502, dated Jun. 12, 2008.

* cited by examiner

*Primary Examiner* — Ren Yan
*Assistant Examiner* — Shema Freeman
(74) *Attorney, Agent, or Firm* — Richard M. Goldberg

(57) ABSTRACT

An installation for preparing dampening solutions for offset printing with a device (10, 62, 72) for preparing a dampening solution and a device (40, 60, 70 for feeding one or more basic liquid materials (42) for preparing the dampening solution into the device (10, 62, 72) for preparing the dampening solution, in which the feeding device (40, 60, 70) is provided for cooling the basic material or materials (42) or a mixture thereof, which is to be supplied.

10 Claims, 2 Drawing Sheets

EQUIPMENT FOR PREPARING DAMPENING SOLUTIONS FOR OFFSET PRINTING

BACKGROUND OF THE INVENTION

The present invention relates to an installation for preparing dampening solutions for offset printing with a device for preparing a dampening solution and a device for feeding one or more basic liquid materials for preparing the dampening solution into the device for preparing the dampening solution.

In offset printing, it is necessary to wet the surface of the offset printing plate with a dampening solution, which prevents acceptance of printing ink by the non-printing places of the offset printing plate. It is generally customary to cycle the dampening solution between the printing press and a device for preparing dampening solution, in which the dampening solution is formulated from different basic materials. In this way, the dampening solution, consumed in the printing process, can be replaced continuously by fresh dampening solution.

Such systems for preparing and supplying dampening solutions are generally known, for example, from the European patent application 02 004 480 of the Applicant. The known equipment comprises cooling devices, which ensure that the prepared dampening solution, supplied to the printing press, has a suitable process temperature, so that the alcohol, contained in the dampening solution, does not evaporate and the flowing and wetting behaviors are optimized. For wet offset printing, a dampening solution temperature ranging from 8° to 12° C. is typical and must be adhered to with a tolerance not exceeding ±1° C. Fluctuations in the temperature of the dampening solution, supplied to the printing rollers, lead to a change in the quality of the printing result. It is therefore appropriate that the cooling system in the dampening solution cycle comprises a control segment, which, on the basis of an actually measured temperature of the dampening solution, controls the temperature of the dampening agent, supplied to the printing rollers, at a nominal value.

If new basic materials, the temperature of which differs appreciably from the temperature existing in the cycling dampening solution, are fed into the device for preparing dampening solution for the purpose of preparing fresh dampening solution, it may happen that the device for cooling the dampening solution cannot eliminate this difference because of the reaction time required by the control segment, so that the temperature of the dampening solution is subjected to fluctuations. In such a case, the temperature may leave the specified tolerance range, so that problems arise in the printing process.

SUMMARY OF THE INVENTION

It is an object of the present invention to construct an installation of the type described above in such a manner that, independently of the temperature of the basic materials, which are available for feeding the device for preparing dampening solution, cooling of the prepared dampening solution to a specified process temperature is possible. In particular, it is an object to avoid larger fluctuations in the process temperature of the dampening solution prepared, which may have a negative effect on the printing process.

In order to accomplish this object, the inventive installation for preparing dampening solution is characterized by the distinguishing features of claim 1.

Pursuant to the invention, the device for feeding basic materials to the device for preparing dampening solution is intended to cool the basic materials, so that the latter reach the device for preparing the dampening solution already in a pre-cooled state. If the basic materials are already cooled down largely to the desired process temperature of the dampening solution, temperature fluctuations in the cycling dampening solution, which arise suddenly, can be avoided. The remaining small temperature differences can be equalized by the already known cooling devices in the cycling dampening solution in the feed line to the printing roller. By the inventive pre-cooling of the basic materials in this way, it is achieved that the process temperature of the dampening solution always remains within the tolerance range, in which the printing result has a constant quality.

Preferred embodiments of the invention arise out of the dependent claims.

BRIEF DESCRIPTION OF THE DRAWINGS

In the following, preferred examples of the invention are explained in greater detail by means of the drawing, in which.

DETAILED DESCRIPTION

Figure 1:
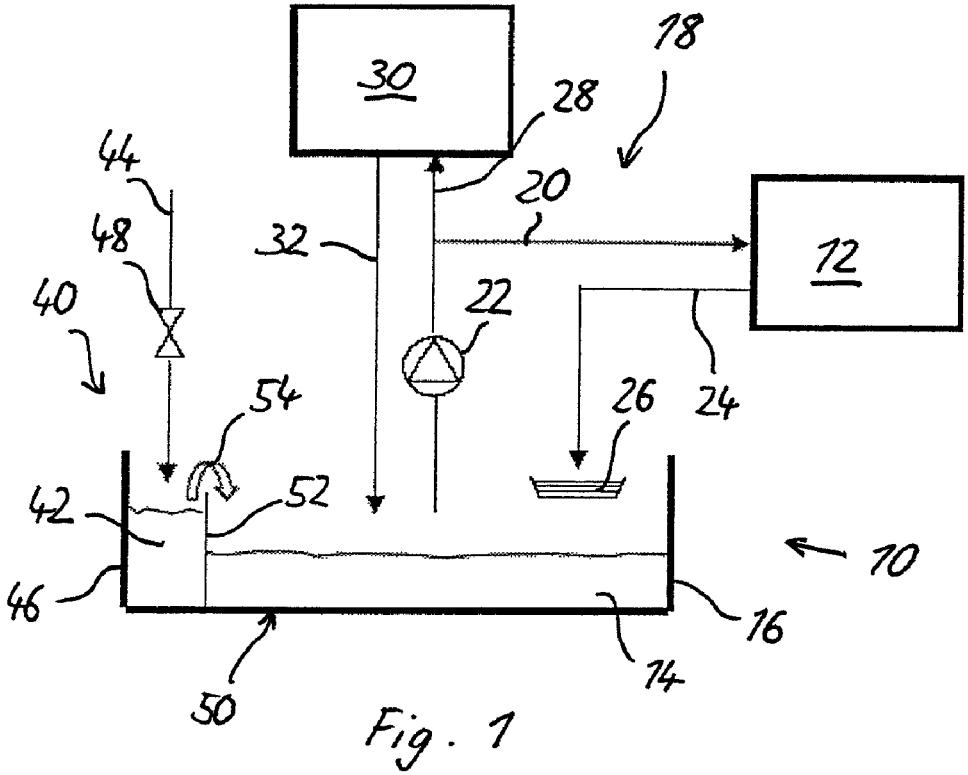
FIGS. 1 to 3 show diagrammatic presentations of different embodiments of the inventive installation for preparing dampening solution.

The installation, shown in FIG. 1, comprises a device 10 for preparing a dampening solution for an offset printing press 12. This device 10 for preparing a dampening solution comprises a dampening solution tank 16, which, at the same time, is a component of the dampening solution cycle 18, in which the dampening solution 14 is pumped to the printing press 12 and back again to the dampening solution tank 16. For this purpose, a pump 22 is disposed in the inlet 20 of the printing press 12. The dampening solution, returning through the return line 24, is filtered through a filter 26 before it reaches the dampening solution tank 16 once again. In this way, contamination and foreign material, which accumulate in the dampening solution during the printing process, are filtered out of the dampening solution cycle 18.

In order to achieve an optimum printing result, the dampening solution 14 is cooled to a specified process temperature. For this purpose, a portion of the dampening solution, circulating in the dampening solution cycle 18, is diverted through a secondary pipeline 28 out of the inlet 20 of the printing press 12 and supplied to a cooling unit 30. The dampening solution, cooled by the cooling unit 30, is passed through a return pipeline 32 back into the dampening solution tank. The temperature of the dampening solution 14 in the dampening solution tank 16 can be controlled by the cooling performance of the dampening solution cooling unit 30 and by the proportion of dampening solution, which is diverted through the secondary pipeline 28 from the inlet 20 of the printing press 12. Typically, this temperature is constant, ranging from about 6° to 12° C. with a tolerance of ±1° C. and preferably of ±0.5° C. Fluctuations of the temperature in the dampening solution cycle 18 can be equalized by a control segment, which is not shown and extends between the cooling unit 30 and the tank 16 of the dampening solution. The output of the cooling unit 30 is increased if the temperature of the dampening solution 14, which is stored in the dampening solution tank 16, increases. Alternatively, the proportion of dampening solution, diverted to the cooling unit 30, can be increased. Furthermore, it is possible to measure the actual temperature of the dampening solution by means of a sensor at a different place in the dampening solution cycle 18, for example, directly in the region of the printing roller.

During the printing process, dampening solution is consumed, so that the amount of dampening solution 14, kept in the dampening solution tank 16, gradually becomes less. This loss is compensated for in that the basic liquid materials for producing new dampening solution are supplied to the device for preparing dampening solution through a feeding device, which is generally labeled 40 in FIG. 1 on the left. The basic liquid materials are, in particular, water, alcohol, as well as additives, such as antimicrobial materials, surfactants or the like. For each of the individual basic materials, it is possible to use a separate feeding device 40 of the type here. Alternatively, a single feeding device 40 can be used for an already existing mixture of basic materials or such a mixture, as explained in even greater detail in the following, may be formed within the feeding device 40 itself.

The basic material 42 is passed through a basic material feed line 44 into a prechamber 46. The basic material feed line 44 comprises a shut-off valve 48, which permits the material, flowing through the feed line 44, to be controlled or the latter to be shut off completely.

In the example shown here, the prechamber 46 and the dampening solution tank 16 are located in a single container 50 and are separated from one another by a partition 52. If the prechamber 46 is filled over the basic material feed line 44, the basic material 42 can flow over an overflow 54 in the upper region of the partition 52 out of the prechamber 46 into the dampening solution tank 16. If several basic material feed lines 44 for different basic materials, such as water, alcohol and the like, discharge into the prechamber 46, then a mixture of basic materials, which forms the dampening solution, is already present within the prechamber 46. In the strict sense of the word, the present invention therefore relates not only to a pre-cooling of individual basic materials, but also to the pre-cooling of a mixture of basic materials, which forms a dampening solution kept within the pre-chamber 46 and is passed into the dampening solution tank 16 in the pre-cooled state and is available there to the above-described dampening solution cycle 18.

In the example shown here, this pre-cooling takes place due to the thermal coupling between the pre-chamber 46 and the dampening solution tank 16, which are separated from one another only by the partition 52 within the tank 50. Accordingly, the basic material 42 or the mixture of basic materials within the prechamber 46 is cooled through the partition 52 by the dampening solution 14 in the dampening solution tank 16, which is cooled constantly to the process temperature by the dampening solution cooling unit 30. By these means, excessive temperature fluctuations, which cannot be equalized in good time due to the inertia of the control system of the cooling unit 30, are avoided when the dampening solution tank 16 is filled with basic materials or the dampening solution mixture from the prechamber 46. The process temperature of the dampening solution can therefore also be kept largely constant also during the refilling process.

The prechamber 46 can also be coupled thermally with the dampening solution tank 16 in other ways. For example, the prechamber 46 may be constructed as an independent container, one wall of which is in contact with the outer wall of the dampening solution tank 16. Furthermore, it is conceivable to construct the prechamber 46 in such a way, that it is surrounded at least partly by the dampening solution tank 16.

Figure 2:
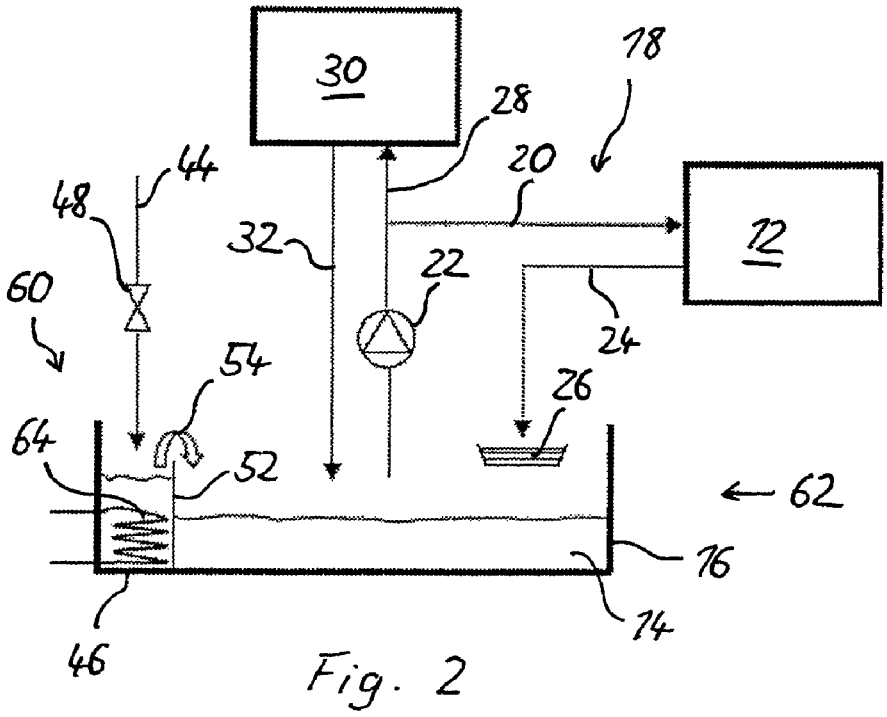

FIG. 2 shows a modification of the embodiment of FIG. 1, for which the feeding device 60 of the installation for preparing dampening solution comprises a cooling unit 64 for cooling the basic material 42. This cooling unit is a cooling coil 64, which extends within the prechamber 46 for cooling the basic material 42 and through which a cooling medium, such as water, flows. In this way, the basic material 42 or a mixture of basic materials within the prechamber 46 is cooled not only through the partition 52 separating the dampening solution tank 16 and, with that, by the dampening solution 14 itself, which is kept in the dampening solution tank 16, but also through an independent cooling unit.

Figure 3:
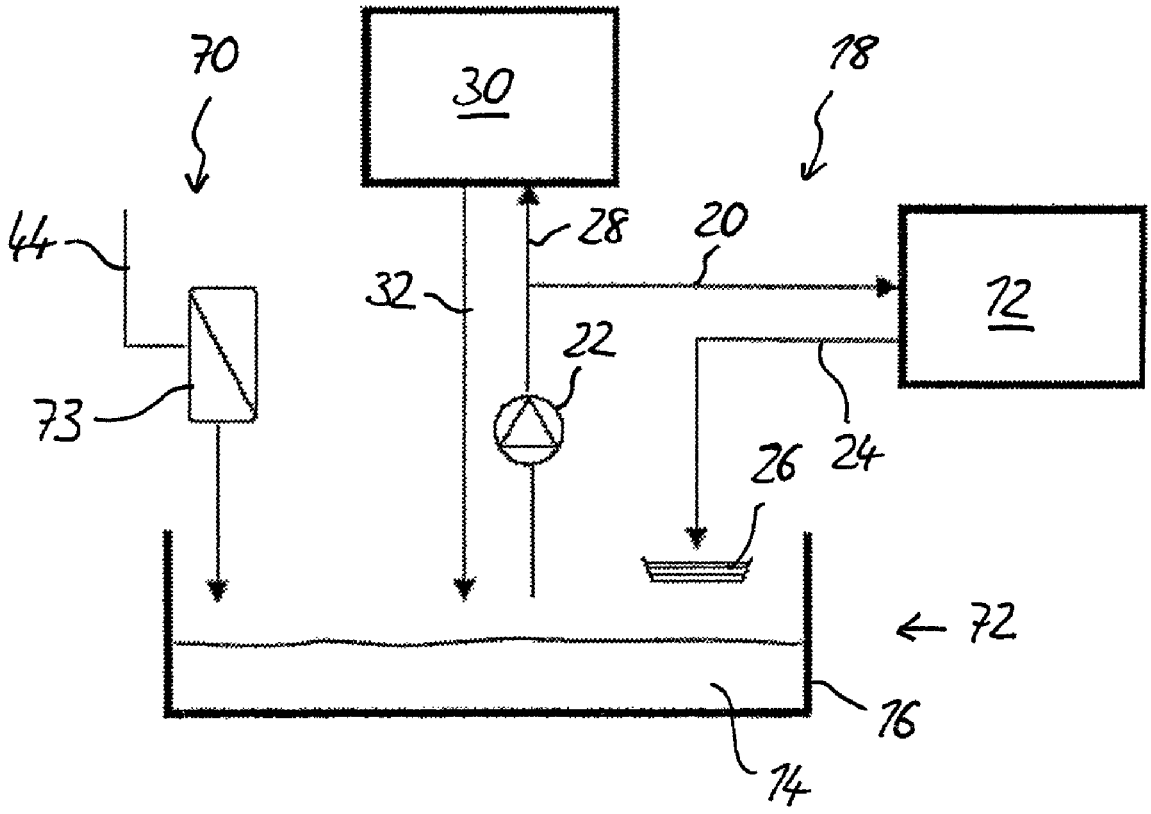

The feeding device 70 of the installation for preparing dampening solution in FIG. 3 feeds a basic material 42 or mixture of basic materials, already precooled within the basic material feed line 44, into the dampening solution tank 16. Interim storage of the basic material 42 within a prechamber is omitted here, since the basic material 42 is already precooled by a cooling unit 73 to such an extent, that its introduction into the dampening solution tank cannot lead to a temperature fluctuation within the dampening solution cycle 16. In the ideal case, the cooling unit 73 cools the basic material 42 within the basic material feed line 44 already to the process temperature, so that, when the dampening solution 14 lost is compensated for, additional cooling performance by the dampening solution cooling unit 30 is not required.

In a further embodiment, not shown in the Figures, the basic material can be passed through a coil around the dampening solution tank, so that it is coupled thermally with the latter. Before the basic material flows out of the end of the coil into the dampening solution tank 16, it is accordingly cooled through the outer wall of the dampening solution tank 16. The coil, in much the same way as the prechamber 46, forms a buffer, in which a flowing volume of basic material, which is coupled thermally with the dampening solution 14 within the dampening solution tank 16, is pre-cooled by the latter.

In all the embodiment shown here, it is possible to integrate the device 10, 62, 72 for preparing the dampening solution, which is connected by the dampening solution cycle 18 with the printing press 12, and the feeding device 40, 60, 70 in a peripheral device, which is to be made available to a printing press, so that a space-saving and compact construction is attained.

What is claimed is:

1. An installation for preparing dampening solution for offset printing comprising:

a device for refining the dampening solution comprising a dampening solution tank for storing the dampening solution, a dampening device of a printing machine to which the dampening solution from the dampening solution tank is supplied, a feeding device for newly for the first time feeding at least one basic liquid material into the dampening solution tank to create said dampening solution, the feeding device comprising an arrangement for cooling the at least one basic material or a mixture thereof, prior to the at least one basic material or the mixture thereof being newly for the first time fed into the dampening solution tank, the feeding device comprises a pre-chamber for interim storage of the at least one basic material or the mixture thereof, wherein the pre-chamber is at least partly enclosed by the dampening solution tank, wherein the pre-chamber feeds the at least one basic material or mixture thereof into the dampening solution tank by an overflow wall.

2. The installation of claim 1, wherein the pre-chamber shares an outer wall of the dampening solution tank.

3. The installation of claim 1, wherein the feeding device comprises a coil, through which the at least one basic material or the mixture thereof flows, around the dampening solution tank.

4. The installation of claim 1, wherein the arrangement for cooling comprises a cooling unit for cooling the at least one basic material or the mixture thereof.

5. The installation of claim 4, wherein the cooling unit is disposed within the pre-chamber.

6. The installation of claim 5, wherein the cooling unit is constructed as a cooling coil, through which a cooling agent flows.

7. The installation of claim 6, wherein the cooling agent is water.

8. An installation for preparing dampening solution for offset printing comprising:

a dampening solution tank for storing a dampening solution, a feeding device for newly feeding at least one basic liquid material into the dampening solution tank to create said dampening solution, a first cooling arrangement associated with the feeding device for cooling the at least one basic liquid material or a mixture thereof, prior to the at least one basic material or the mixture thereof being initially fed into the dampening solution tank, and a second cooling arrangement separate from the first cooling arrangement for cooling the dampening solution from said dampening solution tank, wherein the first cooling arrangement includes a pre-chamber for the interim storage of the at least one basic material or the mixture thereof, from which the at least one basic material or the mixture thereof is adapted to be fed into the dampening solution tank by an overflow wall, and the pre-chamber is at least partly enclosed by the dampening solution tank, wherein the first cooling arrangement includes a cooling unit disposed within the pre-chamber.

9. The installation of claim 8, wherein the cooling unit includes a cooling coil through which a cooling agent flows.

10. The installation of claim 8, wherein the first cooling arrangement includes a cooling unit which cools the at least one basic liquid material prior to supply of the at least one basic liquid material into the dampening solution tank.

* * * * *